US010643812B2

(12) United States Patent
Wu

(10) Patent No.: US 10,643,812 B2
(45) Date of Patent: May 5, 2020

(54) METHOD FOR AVOIDING ELECTRIC ARC WHEN CONNECTING OR DIS-CONNECTING OBJECT TO RELAY

(71) Applicant: Sung-Jen Wu, New Taipei (TW)

(72) Inventor: Sung-Jen Wu, New Taipei (TW)

( * ) Notice: Subject to any disclaimer, the term of this patent is extended or adjusted under 35 U.S.C. 154(b) by 96 days.

(21) Appl. No.: 16/072,522

(22) PCT Filed: Jan. 16, 2017

(86) PCT No.: PCT/CN2017/000113
§ 371 (c)(1),
(2) Date: Jul. 25, 2018

(87) PCT Pub. No.: WO2018/129632
PCT Pub. Date: Jul. 19, 2018

(65) Prior Publication Data

US 2019/0035570 A1 Jan. 31, 2019

(51) Int. Cl.

| | |
|---|---|
| ***H01H 50/14*** | (2006.01) |
| ***H01H 50/54*** | (2006.01) |
| ***H01H 50/44*** | (2006.01) |
| ***H01H 9/38*** | (2006.01) |
| *H01H 9/50* | (2006.01) |

(52) U.S. Cl.
CPC ..... *H01H 50/14* (2013.01); *H01H 9/38* (2013.01); *H01H 50/443* (2013.01); *H01H 50/54* (2013.01); *H01H 9/50* (2013.01)

(58) Field of Classification Search
CPC ..... H01H 9/38; H01H 50/14; H01H 50/443; H01H 50/54; H01H 9/50
See application file for complete search history.

(56) References Cited

U.S. PATENT DOCUMENTS

| | | | | |
|---|---|---|---|---|
| 2,224,873 | A * | 12/1940 | Larson | H01H 29/18 335/53 |
| 2,668,207 | A * | 2/1954 | Bengtsson | H01H 50/54 335/119 |
| 2,946,872 | A * | 7/1960 | Siebers | H01H 50/54 335/121 |
| 3,621,112 | A * | 11/1971 | Beryl | H05K 3/306 174/50.52 |
| 8,228,143 | B2 * | 7/2012 | Takano | H01H 50/047 335/202 |
| 8,279,028 | B2 * | 10/2012 | Yokoyama | H01H 50/14 335/132 |
| 2010/0029111 | A1 * | 2/2010 | Yuba | H01R 13/7038 439/188 |
| 2015/0288168 | A1 * | 10/2015 | Lee | H02H 11/007 361/91.1 |

* cited by examiner

*Primary Examiner* — Mohamad A Musleh
(74) *Attorney, Agent, or Firm* — Rosenberg, Klein & Lee

(57) ABSTRACT

A method for avoiding generating electric arc when connecting an object to or disconnecting an object from a relay, wherein when connecting the relay to the object, the contact terminal of the relay first electrically contacts with the object, and then the coil terminal of the relay is electrically in contact with the object. When disconnecting the object from the relay, the coil terminal of the relay is first electrically disconnect from the object, and the contact terminal of the relay is then electrically disconnected from the object.

3 Claims, 11 Drawing Sheets

METHOD FOR AVOIDING ELECTRIC ARC WHEN CONNECTING OR DIS-CONNECTING OBJECT TO RELAY

BACKGROUND OF THE INVENTION

1. Fields of the Invention

The present invention relates to a relay, and more particularly, to a method for avoiding generating electric arc when connecting an object to or disconnecting an object from a relay.

2. Descriptions of Related Art

The conventional relays are an automatic control device in which the settings of valves, switches, etc. are regulated by a powered element, such as a motor, solenoid, or pneumatic mechanism actuated by a smaller, sensitive element. The relays use a small current to control a device requiring a large current such as motors, transformers, heaters and bulbs. When current passes through the coil, the magnetic force generated by the coil attracts the board of the relay to change the contact points. When the current disappears, the board returns to its initial position by the recovery force of the spring. Therefore, the relay controls operation of other devices.

However, the contact points of the relay will have a discharge within a certain distance during the status of "ON" and "OFF". This is often known as the electric arc.

As shown in FIG. 11, another situation may also cause the electric arc, especially when an object 10 such as a plug, a machine or a circuit, is connected to or disconnected from a relay 1. The coil terminal 11 and the contact terminal 12 of the relay 1 have the same length, and the object 10 includes a first clip 101 and a second clip 102 that has the same length as that of the first clip 101. The first and second clips 101, 102 respectively clamp the coil terminal 11 and the contact terminal 12 of the relay 1. When connecting the object 10 to the relay 1, or when disconnecting the object 10 from the relay 1, because of the same length of the coil terminal 11 and the contact terminal 12, and the same length of the first and second clips 101, 102, so that at the status as disclosed in FIG. 11, the coil terminal 11 and the contact terminal 12 are not completely separated from the first and second clips 101, 102, electric arc may happen to damage the relay 1 and the object 10.

The present invention is intended to provide a method for avoiding generating electric arc when connecting an object to or disconnecting an object from a relay.

SUMMARY OF THE INVENTION

The present invention relates to a method for avoiding generating electric arc when connecting an object to or disconnecting an object from a relay. When connecting the relay to the object, the contact terminal of the relay is electrically in contact with the object first, and a coil terminal of the relay is then electrically in contact with the object. When disconnecting the object from the relay, the coil terminal of the relay is first electrically disconnect from the object, the contact terminal of the relay is then electrically disconnected from the object.

Preferably, the coil terminal extends the length of X1 from the face of the relay, and the contact terminal extends another length of X2 from the face of the relay, wherein the X1 is shorter than the X2.

Preferably, the object includes a contact face which faces the relay. A first slot and a second slot are respectively defined in the contact face. A first clip is located in the first slot so as to clamp the contact terminal, and a second clip is located in the second slot so as to clamp the coil terminal. The shortest distance between the first clip and the contact face is defined as Y1, and the shortest distance between the second clip and the contact face is defined as Y2, wherein the Y1 is shorter than the Y2.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
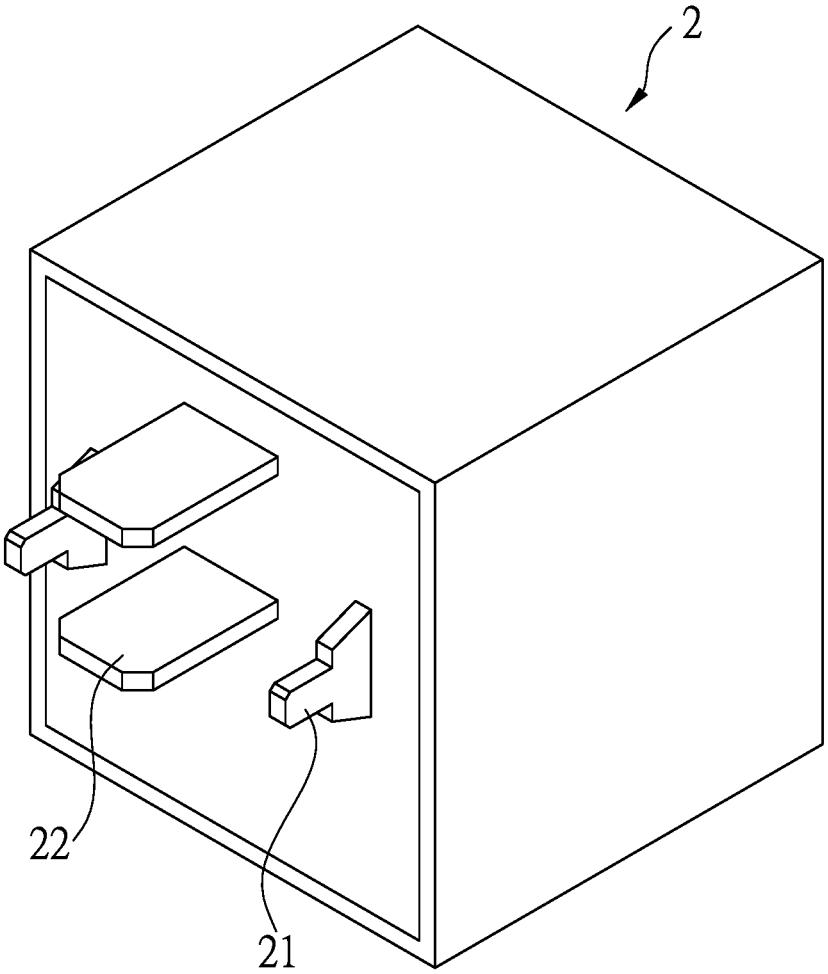
FIG. 1 is a perspective view to show the relay of the present invention.
Figure 2:
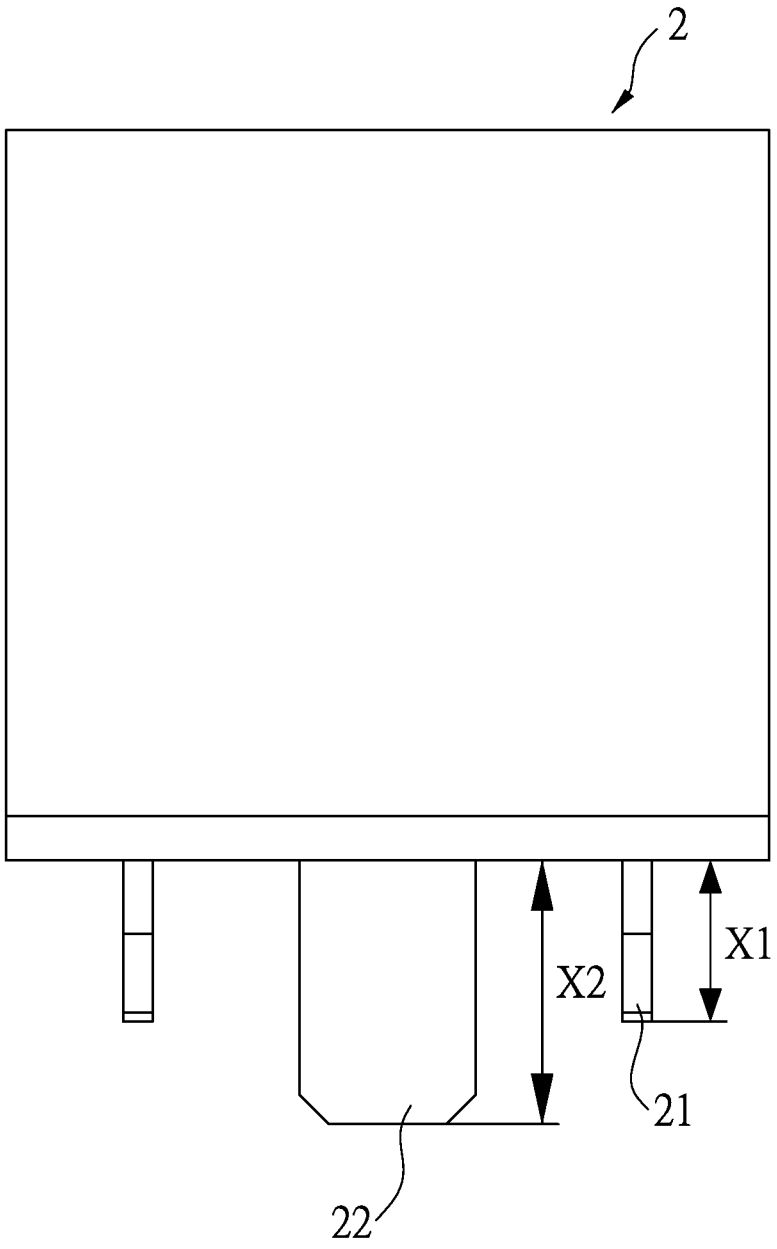
FIG. 2 is a side view to show the relay of the present invention.

Referring to FIGS. 1 to 4, the present invention relates to a method of the present invention for avoiding generating electric arc when connecting an object 3 to or disconnecting an object 3 from a relay 2. In this embodiment, the relay 2 includes two coil terminals 21 and two contact terminals 22. The coil terminals 21 each extend a length of X1 from the face of the relay 2, and the contact terminals 22 each extend another length of X2 from the face of the relay 2. The X1 is shorter than the X2. The object 3 includes four slots 31.

Figure 3:
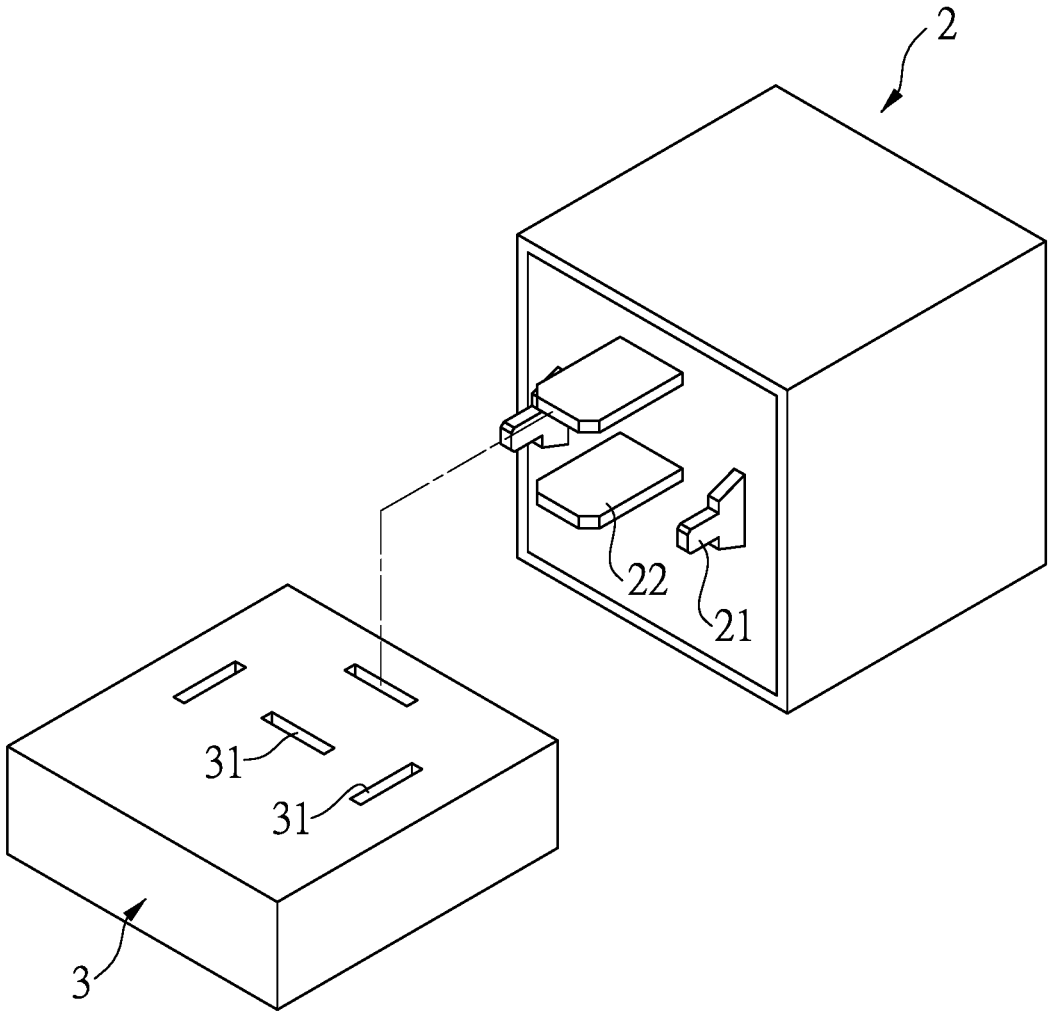
FIG. 3 shows the relay of the present invention and the object to be connected with the relay.
Figure 4:
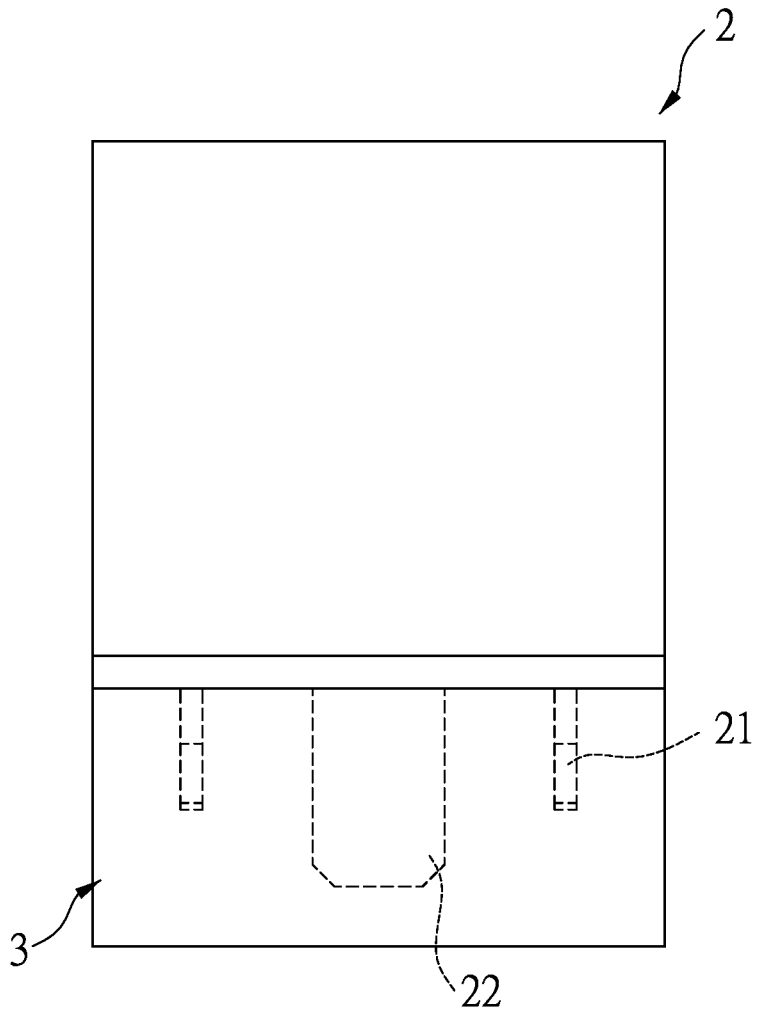
FIG. 4 is a plane view to show that the relay of the present invention is connected with the object.

As shown in FIGS. 3 and 4, when connecting the relay 2 to the object 3, the contact terminals 22 and the coil terminals 21 are inserted into the slots 31 of the object 3 to fully connect the relay 2 to the object 3. It is noted that because the contact terminals 22 are longer than the coil terminals 21, so that the contact terminals 22 of the relay 2 are electrically in contact with the object 3 first, and the coil terminals 21 of the relay 2 are then electrically in contact with the object 3.

Figure 5:
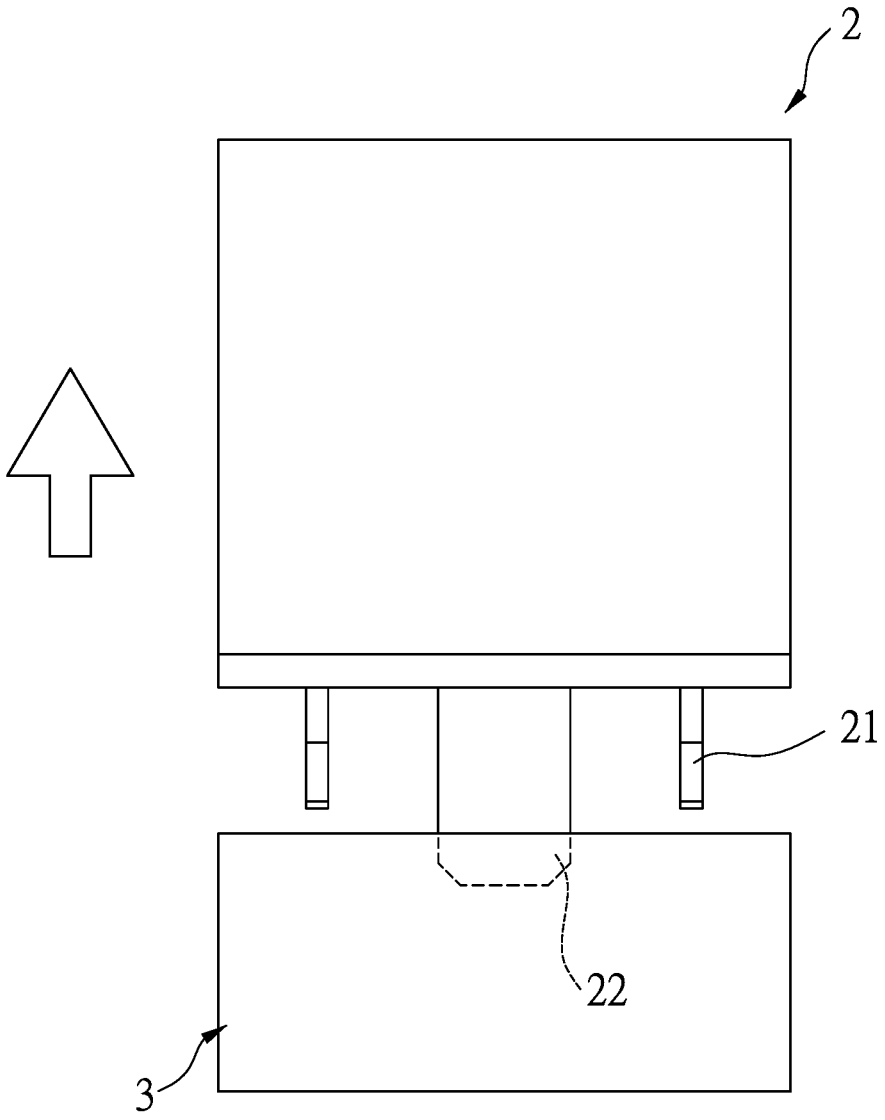
FIG. 5 shows one status that when the relay of the present invention is to be disconnected from the object, only the coil terminals are disconnected from the object.
Figure 6:
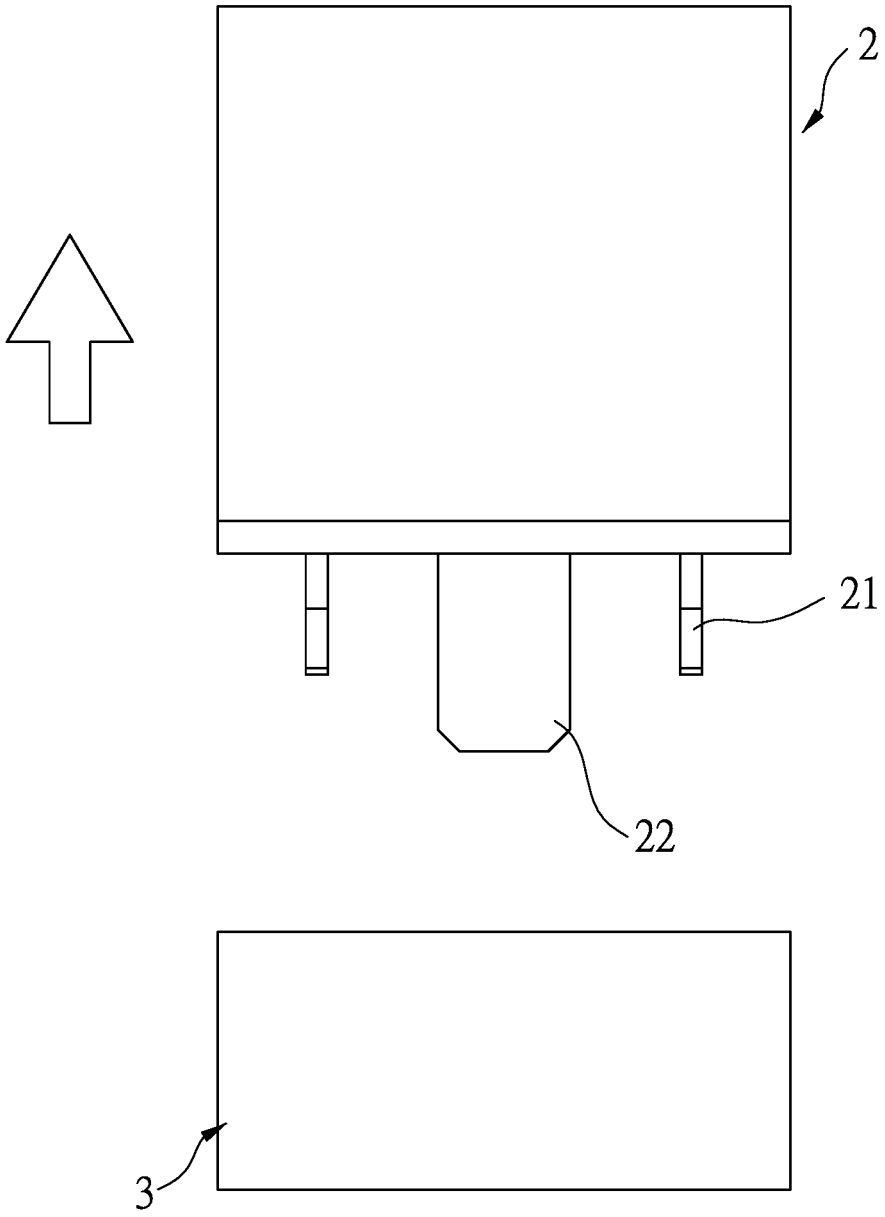
FIG. 6 shows that when the relay of the present invention is disconnected from the object, and the coil terminals and the contact terminals are disconnected from the object.

As shown in FIGS. 5 and 6, when disconnecting the object 3 from the relay 2, the coil terminals 21 of the relay 2 are electrically disconnect from the object 3 first, and the contact terminals 22 of the relay 2 are then electrically disconnected from the object 3 until the object 3 is fully disconnected from the relay 2. There will be no electric arc generated to damage the object 3 or the relay 2.

FIGS. 5 to 10 show a connection between an object 4 and a relay 5, wherein the relay 5 includes a coil terminal 51 and a contact terminal 52, the length of the coil terminal 51 is the same as that of the contact terminal 52. The object 4 includes a contact face 41 which faces the relay 5. A first slot 42 and a second slot 43 are respectively defined in the contact face 41. A first clip 44 is located in the first slot 42 so as to clamp the contact terminal 52, and a second clip 45 is located in the second slot 43 so as to clamp the coil terminal 51. The shortest distance between the first clip 44 and the contact face 41 is defined as Y1, and the shortest distance between the second clip 45 and the contact face 41 is defined as Y2, the Y1 is shorter than the Y2.

Figure 7:
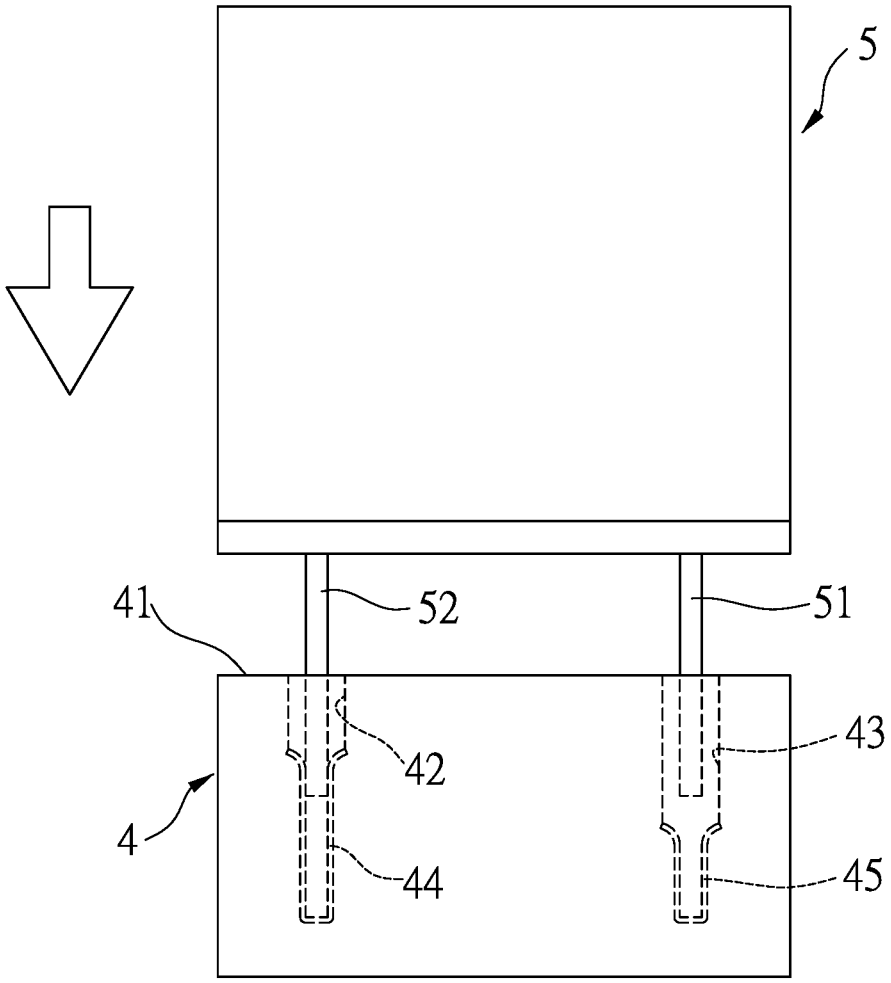
FIG. 7 shows that when connecting the relay to the object, only the contact terminal is clamped by the first clip, and the coil terminal is not yet clamped by the second clip.
Figure 8:
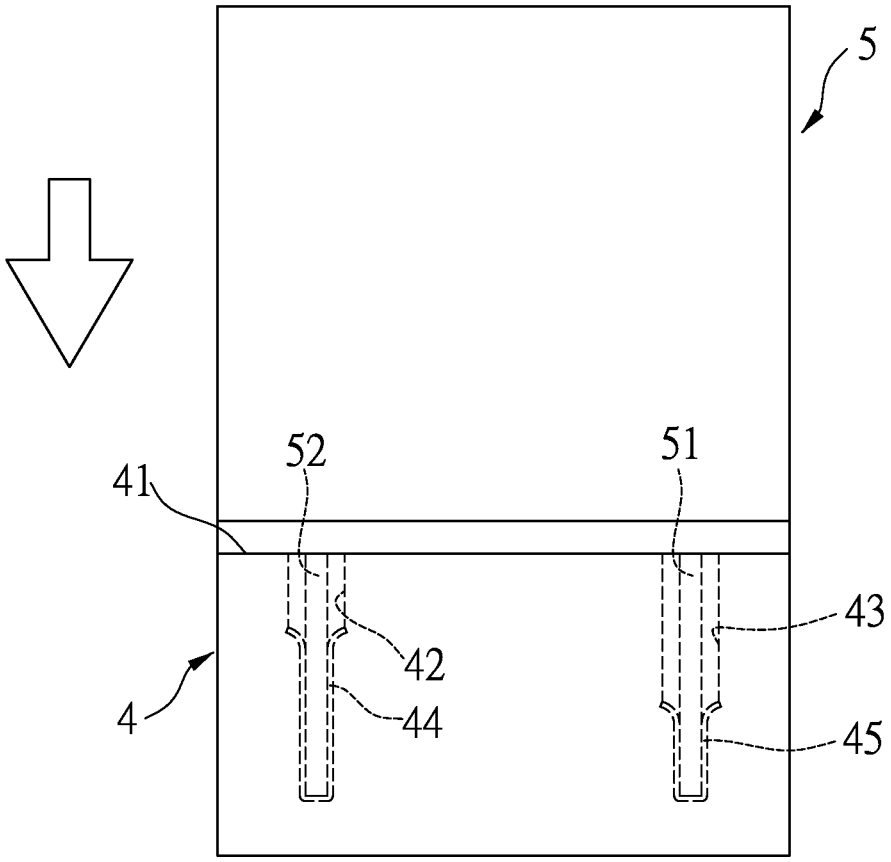
FIG. 8 shows that the relay is fully connected to the object, the contact terminal is clamped by the first clip, and the coil terminal is clamped by the second clip.
Figure 9:
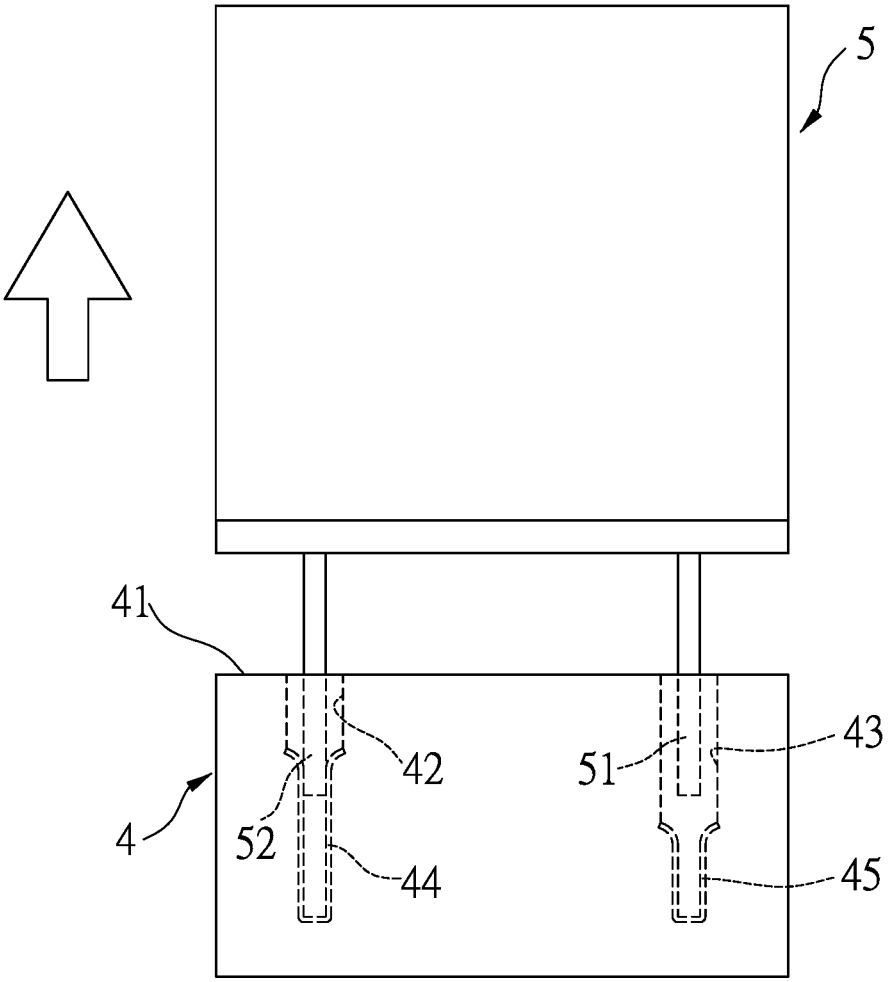
FIG. 9 shows that when disconnecting the relay from the object, only the contact terminal is still clamped by the first clip, and the coil terminal is disconnected from the second clip.
Figure 10:
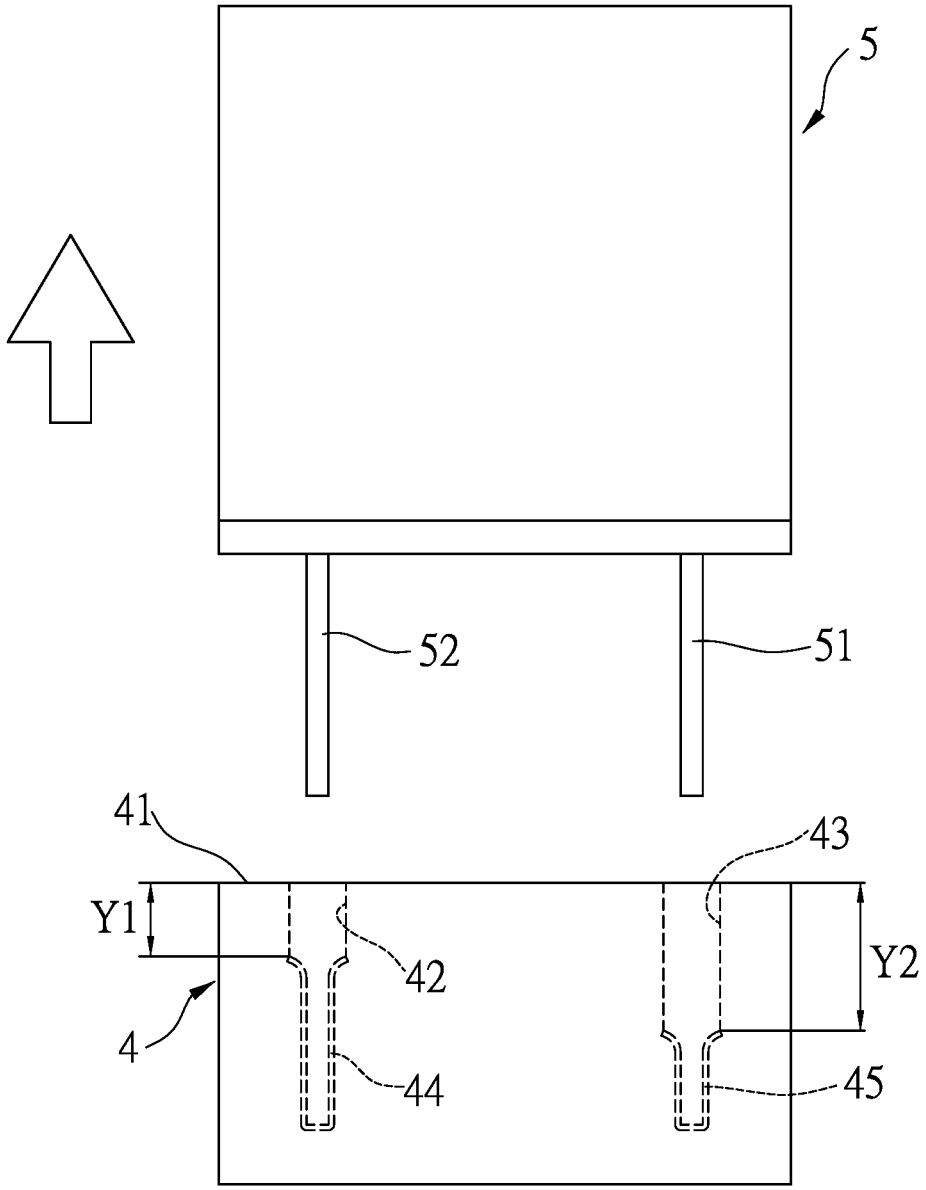
FIG. 10 shows that the relay is fully disconnected from the object.
Figure 11:
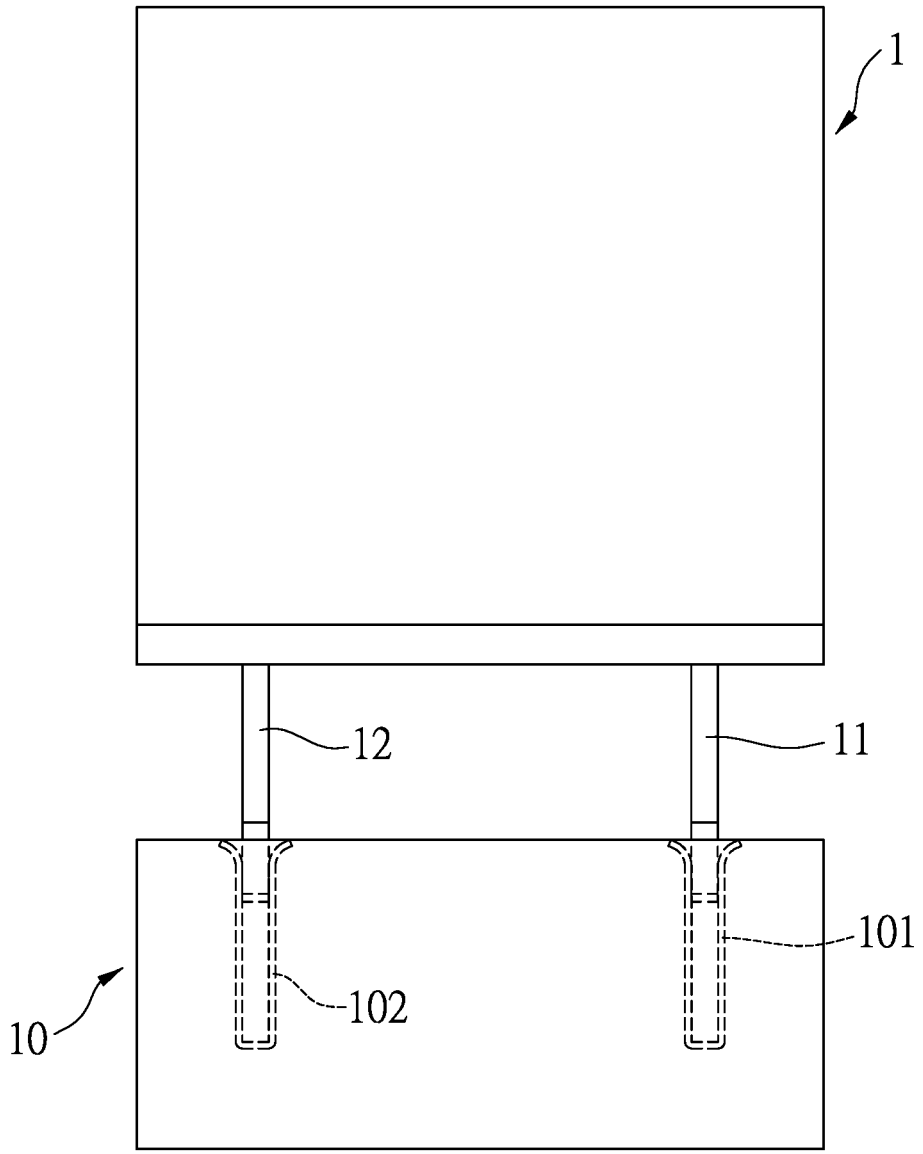
FIG. 11 shows the conventional relay wherein the coil terminal and the contact terminal have the identical length, and the coil terminal and the contact terminal are not yet fully disconnected from the first and second clips of the object.

When connecting the relay 5 to the object 5, the contact terminal 52 contacts the first clip 44 first as shown in FIG. 7, and then the coil terminal 51 contacts second clip 45 as shown in FIG. 8. When disconnecting the object 4 from the relay 5, the coil terminal 51 is disconnected from second clip 45 first as shown in FIG. 9, and then, the contact terminal 52 is disconnected from the first clip 44 as shown in FIG. 10.

While we have shown and described the embodiment in accordance with the present invention, it should be clear to those skilled in the art that further embodiments may be made without departing from the scope of the present invention.

What is claimed is:

1. A method for avoiding generating electric arc when connecting an object to or disconnecting an object from a relay, wherein:

when connecting the relay to the object, a contact terminal of the relay is electrically in contact with the object, and a coil terminal of the relay is then electrically in contact with the object, when disconnecting the object from the relay, the coil terminal of the relay is electrically disconnected from the object, the contact terminal of the relay is then electrically disconnected from the object.

2. The method as claimed in claim 1, wherein the coil terminal extends a length of X1 from a face of the relay, the contact terminal extends another length of X2 from the face of the relay, the X1 is shorter than the X2.

3. The method as claimed in claim 1, wherein the object includes a contact face which faces the relay, a first slot and a second slot are respectively defined in the contact face, a first clip is located in the first slot so as to clamp the contact terminal, a second clip is located in the second slot so as to clamp the coil terminal, a shortest distance between the first clip and the contact face is defined as Y1, a shortest distance between the second clip and the contact face is defined as Y2, the Y1 is shorter than the Y2.

* * * * *